US011497093B2

(12) United States Patent
Berg et al.

(10) Patent No.: US 11,497,093 B2
(45) Date of Patent: Nov. 8, 2022

(54) HIGH-POWER LIGHT SYSTEM

(71) Applicant: Carpe Diem Technologies, Inc., Franklin, MA (US)

(72) Inventors: John S. Berg, Mattapoisett, MA (US); Sondre Brandso, Somerset, MA (US); Matthew Lepine, Cumberland, RI (US)

(73) Assignee: CARPE DIEM TECHNOLOGIES, INC., Franklin, MA (US)

( * ) Notice: Subject to any disclaimer, the term of this patent is extended or adjusted under 35 U.S.C. 154(b) by 106 days.

(21) Appl. No.: 16/779,416

(22) Filed: Jan. 31, 2020

(65) Prior Publication Data

US 2020/0253014 A1 Aug. 6, 2020

Related U.S. Application Data

(60) Provisional application No. 62/799,931, filed on Feb. 1, 2019.

(51) Int. Cl.

| | |
|---|---|
| ***H05B 45/18*** | (2020.01) |
| ***H05B 47/14*** | (2020.01) |
| ***H05B 47/17*** | (2020.01) |
| ***H05B 47/28*** | (2020.01) |

(52) U.S. Cl.

CPC ..... *H05B 45/18* (2020.01); *H05B 47/14* (2020.01); *H05B 47/17* (2020.01); *H05B 47/28* (2020.01)

(58) Field of Classification Search

CPC ..... H05B 45/18; H05B 47/17; H05B 47/28; H05B 47/14

See application file for complete search history.

(56) References Cited

U.S. PATENT DOCUMENTS

2003/0233138 A1* 12/2003 Spooner ..... G02B 6/4249 607/93
2008/0074874 A1* 3/2008 Bradshaw ..... G03B 15/03 362/235
2010/0219736 A1* 9/2010 Dahm ..... H05K 1/0203 313/46
2014/0003074 A1* 1/2014 Kishimoto ..... C09K 11/7734 362/510
2014/0126178 A1* 5/2014 Kishimoto ..... F21S 41/16 362/84

(Continued)

*Primary Examiner* — Anh Q Tran
(74) *Attorney, Agent, or Firm* — Kregsman & Kriegsman

(57) ABSTRACT

A high-power light system includes a lamp for producing light within a designated wavelength range, a chiller for maintaining the lamp below a defined temperature threshold, and a control module for regulating operation of both the lamp and the chiller. The lamp includes a plurality of light emitting diodes (LEDs) arranged into independently-operable modules. In use, the control module selectively overdrives the LEDs to yield high-power light within the designated wavelength range. To prevent overheating within the lamp, the control module restricts the lamp to a pulse-based operational cycle, whereby each period of LED activation is of limited duration and is immediately followed by a period of deactivation at least three times as long in duration as the period of activation. Additionally, one or more temperature sensors are disposed within the lamp and enable the control module to temporarily suspend LED activation when measured temperature levels exceed the defined threshold.

16 Claims, 7 Drawing Sheets

(56) References Cited

U.S. PATENT DOCUMENTS

| | | | | |
|---|---|---|---|---|
| 2016/0066374 | A1* | 3/2016 | Shen | F21K 9/23 315/291 |
| 2018/0147418 | A1* | 5/2018 | Marchese | A61N 5/0624 |
| 2020/0232618 | A1* | 7/2020 | Rudy | H01S 5/2201 |

* cited by examiner

HIGH-POWER LIGHT SYSTEM

CROSS-REFERENCE TO RELATED APPLICATIONS

The present application claims the benefit under 35 U.S.C. 119(e) of U.S. Provisional Patent Application No. 62/799,931, which was filed on Feb. 1, 2019 in the names of John S. Berg et al., the disclosure of which is incorporated herein by reference.

FIELD OF THE INVENTION

The present invention relates generally to the fabrication of miniature structures and, more particularly, to high-power lamps used in the fabrication of miniature structures.

BACKGROUND OF THE INVENTION

High-power lamps are well-known in the art and are commonly used in connection with photolithography, nanoimprint lithography, and other similar processes related to the manufacture of miniature structures (e.g. semiconductors). For instance, one type of high-power lamp which is well known in the art is designed to produce light of a particular wavelength that, in turn, can be utilized to be selectively absorbed to cure photoresist which has been applied to a designated substrate, such as a silicon wafer. In this manner, high-power lamps allow for the precise patterning of miniature structures on the designated substrate.

One well-known type of high-power lamp is a high-pressure, mercury-vapor, arc-discharge lamp. A mercury-vapor lamp is capable of emitting energy within a broad emission spectrum which includes wavelengths of light required for curing various types of photoresists. More specifically, mercury-vapor lamps emit light at wavelengths capable of absorption by G-line photoresists, which cure upon absorption of light at 436 nm in wavelength, H-line photoresists, which cure upon absorption of light at 405 nm in wavelength, and I-line photoresists, which cure upon absorption of light at 365 nm in wavelengths.

Another well-known type of high-power lamp is a high-power, light emitting diode (LED) lamp. A high-power LED lamp commonly includes modules, or arrays, of individual LEDs that are electronically coupled to a central controller which regulates the light emitted by each LED in terms of time and power. More recently, high-power LED lamps have been designed to produce light with relatively narrower emission bands of about 10 nm either at the 365 nm or 405 nm nodes.

High-power, LED-based lamps, while relatively efficient, typically produce a significant amount of heat, with approximately 50-60% of the input energy generating heat during normal operation. This waste energy is generally emitted as infrared (IR) energy. Additionally, energy absorbed by the designated substrate during the curing process is often reemitted at longer wavelengths, including infrared energy. All of the heat generated by high-power, LED-based lamps has consequently been found to introduce certain notable shortcomings.

As a first shortcoming, the significant heat produced by high-power, LED-based lamps can transfer a considerable amount of infrared and non-reactive, or non-actinide, energy onto the substrate, which in turn can negatively affect its chemical and/or structural properties (e.g. resulting in thermal distortion due to locking in the shape at higher temperature or even actual burning or ignition of exposed surfaces). Furthermore, excessive curing of the photoresist, which is affected by heat and dosage control, can cause the substrate to bond onto the master stamper of a nanoimprint lithography system, resulting in considerable complexity, or even damage, when separating the stamp from the substrate which is being imprinted.

As a second shortcoming, the significant thermal energy produced by high-power, LED-based lamps can render the banks of LEDs prone to overheating. This generation of heat reduces the optical output of each LED due to its intrinsic operational properties (i.e. the power output of each LED decreases as temperature rises). As a result, the application of more current to each LED is required in order to maintain the requisite output yield. This additional current applied to each LED produces even more heat which further reduces output. As can be appreciated, if improperly treated, extended overheating of the LEDs can result in permanent damage, thereby necessitating costly replacement.

As a third shortcoming, the significant heat produced by high-power LED-based lamps broadens and shifts the spectrum of energy produced by the lamp. However, under ideal conditions, the presence of unnecessary energy is minimized to the greatest extent possible to produce only the type of energy that is most useful for creating the optimal chemical or phase transformation response.

In view of the shortcomings outlined above, the usage and the designated power output of high-power LED-based lamps are often restricted to limit the transfer of heat onto the designated substrate as well as prevent overheating of the individual LEDs. As can be appreciated, restricting the power output of LED-based lamps, in turn, significantly limits overall manufacturing productivity and resultant product yield.

SUMMARY OF THE INVENTION

It is an object of the present invention to provide a new and improved high-power light system and corresponding method.

It is another object of the present invention to provide a new and improved high-power light system that includes multiple light emitting diodes (LEDs) which selectively emit pulses of light that fall within a designated wavelength range.

It is yet another object of the present invention to provide a high-power light system of the type as described above which is designed to maximize the production of actinide energy, while minimizing the production of non-actinide energy, and in turn to treat any output heat generated therefrom.

It is still another object of the present invention to provide a high-power light system of the type as described above which allows for highly efficient manufacturing productivity and resultant product yield.

It is another object of the present invention to provide a high-power light system of the type as described above which has a limited number of parts, is inexpensive to manufacture and is easy to assemble.

Accordingly, as one feature of the present invention, there is provided a high-power light system, comprising (a) a high-power lamp for producing light within a defined wavelength range, (b) a chiller in thermal communication with the high-power lamp for maintaining the high-power lamp below a defined temperature threshold, and (c) a control module in electrical communication with the high-power lamp and the chiller, the control module regulating the operation of the high-power lamp and the chiller, (d)

wherein the control module restricts activation of the high-power lamp to an operational cycle comprised of periodic pulses of activation.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

High-Power Light System 11

Figure 1:
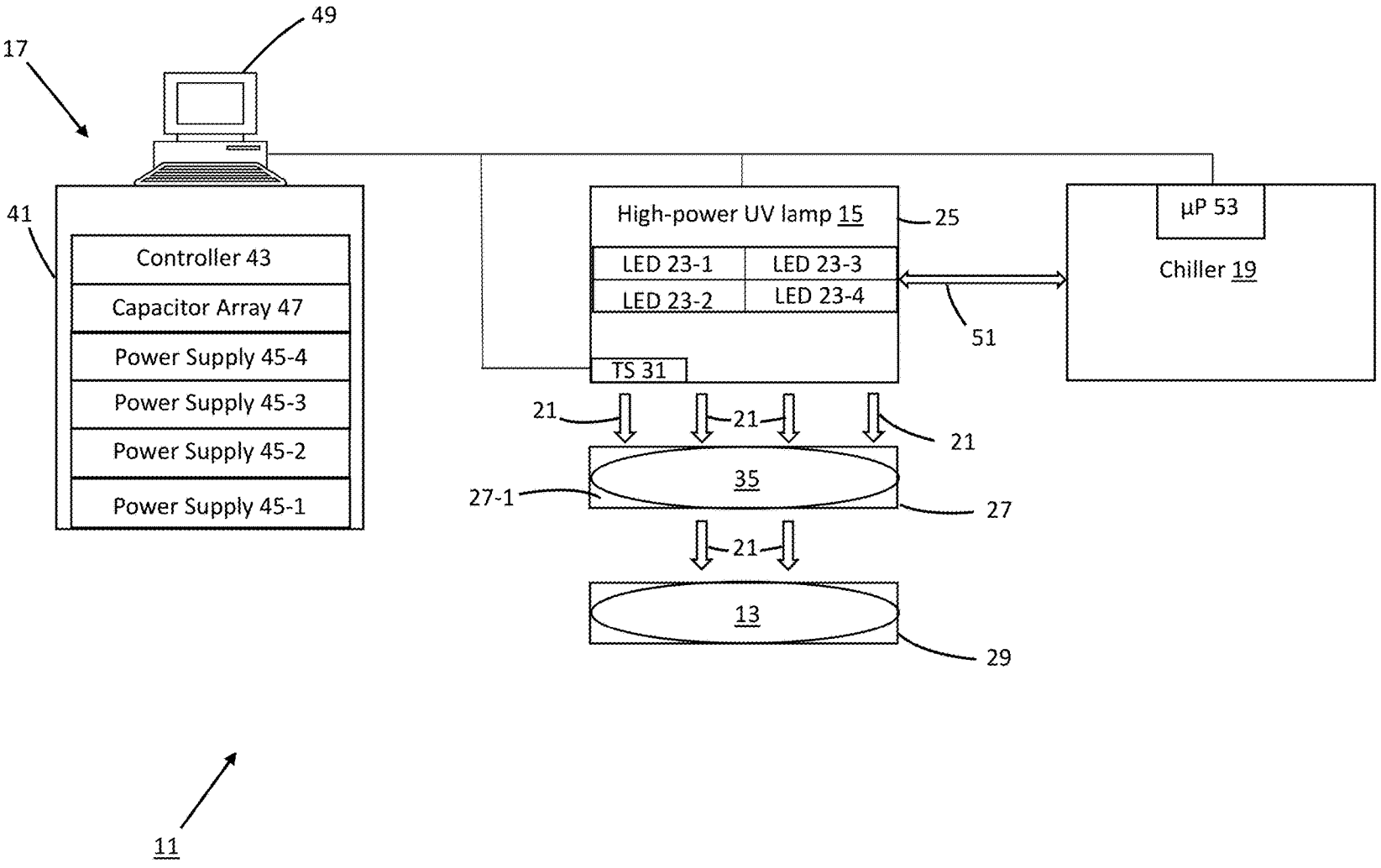
FIG. 1 is a simple schematic representation of a high-power light system constructed according to the teachings of the present invention.

Referring now to FIG. 1, there is shown a simplified schematic representation of a high-power light system, the system being constructed according to the teachings of the present invention and identified generally by reference numeral 11. As will be explained in detail below, light system 11 is specifically designed to (i) emit high-power pulses of light of controlled energy dosage through a designated, user-modifiable, output cycle as well as (ii) monitor and treat any potentially-damaging temperature spikes resulting therefrom.

In the description that follows, system 11 is described in connection with the emission of ultraviolet (UV) light onto a semiconductor wafer-type substrate 13. In this capacity, light system 11 is particularly well-suited for use in curing photoresist applied onto substrate 13 (e.g. as part of the manufacture of miniature structures thereon). However, it should be noted light system 11 is not limited to curing applications and/or use in connection with semiconductor wafers. Rather, it is to be understood that system 11 could be used in alternative applications and/or in connection with different items without departing from the spirit of the present invention.

Additionally, it should be noted system 11 is not restricted to the emission of UV light. Rather, it is to be understood that the particular wavelength of the emitted light could be modified to fall within a range that falls outside of the wavelength of ultraviolet light (i.e., 10 nm to 100 nm). In this manner, the particular wavelength of light produced by system 11 could be selected based on the needs of the intended application.

As can be seen, high-power light system 11 comprises a high-power UV lamp 15, a control module 17 for regulating the principal operations of lamp 15, and a chiller 19 for continuously cooling lamp 15. As a feature of the present invention, system 11 is designed to overdrive UV lamp 15 to produce high-power UV light 21. However, to limit the amount of heat produced by UV lamp 15 that could negatively affect certain properties of substrate 13, control module 17 is designed to (i) restrict activation of UV lamp 15 to periodic pulses at a defined wavelength for a limited duration, and (ii) monitor the heat produced by UV lamp 15 and, as needed, apply an appropriate heat treatment solution thereto (e.g. disable lamp 15 until temperature measurements fall beneath a predefined threshold).

High-Power UV Lamp 15

UV Lamp 15 comprises a plurality of LEDs 23, preferably arranged as separate arrays, banks, or modules 23-1 thru 23-4 that are independently mounted within a common box-like outer housing 25. Preferably, each of modules 23-1 thru 23-4 includes twenty-four LEDs 23 mounted onto a common plate (not shown), the LEDs 23 being arranged, for example, in a 5×5 grid with the center LED removed therefrom. However, it is to be understood that alternative numbers and configurations of LED banks could be contemplated without departing from the spirit of the present invention. In fact, it is envisioned that UV lamp 15 could be alternatively constructed with nine modules of LEDs 23 to increase efficiency and productivity while ensuring that adequate thermal levels are maintained.

As will be explained further below, UV lamp 15 is designed to output each LED 23 at approximately 300%-500% of its nominal power, with UV light 21 generated therefrom having a wavelength in the range of approximately 365-405 nm. However, as referenced above, the wavelength range of light emitted from each LED 23 could be modified, as needed, to suit the particular needs of the intended application.

For instance, as an example of a potential non-UV application, it envisioned that the present invention could be utilized to provide activation energy to initiate chemical reactions or phase transformations. In particular, it is envisioned that this particular application could be achieved using photons of energy with a wavelength that matches the electron band gap of a semi-conductor. For example, it is envisioned that any Vandadium Pentoxide ($V_2O_5$) produced from atomic layer deposition could be converted to Vanadium Dioxide ($VO_2$) through the application of intense energy which is absorbed at the band gap of about 2.2 eV. Consequently, the wavelength of the energy used to initiate this reaction could be calculated using the formula: $\lambda=hc/E_{photon}=6.625E-34\times3E8/(1.6E-19\times2.2)=683$ nm. Thus, in this application, the utilization of a deep-red 680 nm LED lamp would be ideal in order to produce the desired 683 nm wavelength light.

Due to the considerable heat generated from UV lamp 15 by operating at a high-power level, control module 17 is designed to restrict activation of LEDs 23 to periodic pulses of limited duration to prevent overheating. For greater understanding of the present invention, the details of a sample regulated LED power output cycle are provided further below.

Lamp 15 is additionally equipped with (i) a thin plate, or flange, 27 that is mounted onto the open bottom end of housing 25, (ii) a cartridge, or drawer, 29 coupled to the open bottom end of housing 25 over flange 27, and (iii) at least one temperature sensor 31.

Although shown exploded herein for ease of illustration, flange 27 is constructed as a generally thin, rectangular plate that is mounted onto the underside of lamp housing 25. As can be seen, flange 27 is shaped to define a central aperture 35 that directs UV light 21 produced from LEDs 23 through a limited window of fixed dimensions. For instance, aperture 35 may be configured to restrict light emission to a uniform, generally circular, curing area on wafer 13 of approximately 200 mm in diameter.

As a feature of the present invention, the top surface 27-1 of plate 27 is preferably applied with a filter or reflector that prevents any infrared radiation produced from LEDs 23 from being directed onto heat-sensitive regions, such as substrate 13. For instance, UV light 21 directed onto substrate 13 will re-emit photons at different wavelengths (including IR energy), depending upon the state of the curing process on substrate 13. Accordingly, by absorbing, redirecting and/or otherwise retaining IR energy within a particular region of lamp housing 25, top surface 27-1 of plate 27 enables any resultant heat to be more effectively treated by chiller 19.

Although shown exploded herein for ease of illustration, cartridge, or drawer, 29 is preferably mounted onto the open bottom end of housing 25 over plate 27. In use, drawer 29 is dimensioned to retain substrate 13 in a fixed position during the patterning process. For ease of access to substrate 13, drawer 29 may be adapted to slide relative to housing 25.

Temperature sensor (TS) 31 represents any electrical device capable of monitoring temperature produced by lamp 15 (e.g. a thermocouple, IR sensor or photodiode). At least one temperature sensor 31 is preferably mounted at any location suitable for monitoring the temperature proximate to both substrate 13 as well as LEDs 23. Accordingly, at least one temperature sensor 31 could be located, inter alia, (i) on, or proximate to, each of LED modules 23-1 thru 23-4, (ii) at the open bottom end of housing 25 (as shown herein for ease of illustration), (iii) on, or proximate to, plate 27, and/or (iv) most ideally, on, or proximate to, cartridge 29 on which wafer 13 is mounted.

As can be seen, temperature sensor 31 is in electrical communication with control module 17. In this manner, control module 17 is adapted to monitor the ambient temperature at the output of UV lamp 15 and, in turn, initiate a cooling response if the measured temperature exceeds a user-defined threshold (e.g. temporarily disable lamp 15 until measured temperatures fall beneath the threshold).

As a feature of the present invention, it should be noted that temperature sensor 31 may be in the form of one or more photodiodes that are designed primarily to detect and measure the power and wavelength of reflected and re-emitted photons of light.

As a result, in one intended application of system 11, substrate 13 is coated with a photoresist that contains a photodye which is sensitive to the exposure wavelength of light 21. Accordingly, the photodye absorbs the photons of the actinide wavelength, which begins a chemical reaction. A photoacid generator (PAG), of which the dye is a constituent, changes the pH value of the photoresist polymer and the reaction begins. During the course of the chemical reaction, the dye is bleached and becomes clear, thereby enabling a greater amount of light to pass through which, in turn, permits a greater depth in the resist to receive light and subsequently cure. Eventually, the resist becomes significantly more transparent and more light reflects or passes through the underlying substrate. Additionally, the light is also reemitted at different wavelengths through a stokes shift in the material. By compiling and transmitting such information to control module 17, photodiode-type sensors 31 are rendered particularly useful in optimizing the dosage and timing of the curing process as they detect the change in state of the material through measured changes in reflectivity, shift in wavelength (stokes shift), and temperature.

Multiple photodiodes, each with narrow pass or edge cutoff capabilities, can be used to filter the detected wavelength, thus providing sensing of target wavelength intensity as well as any undesirable wavelength shift. This information can be used to provide feedback for control module 17. Wavelength shift is a function of temperature, as nearly all LEDs shift higher in wavelength as junction temperature rises. The detected presence of wavelength shift indicates the need for shorter activation pulses of the LEDs and increased cooling. Alternatively, if a slight increase in wavelength is desired, this condition can be achieved by allowing the LEDs to increase in temperature through the application of lower-energy, longer-durational pulses. A control algorithm can be thus implemented by control module 17 to provide optimal wavelength targeting and control.

Photodiodes further monitor, and consequently minimize the risk of, overexposure of UV light 21 onto substrate 13 (e.g. upon completion of a designated curing process), which would unnecessarily increase thermal energy produced in proximity to lamp 15 and substrate 13. As such, photodiodes would assist in maintaining proper thermal energy levels in and around UV lamp 15. Additionally, photodiodes can be utilized in nanoimprint lithography applications to ensure the proper degree of curing of the photoresist, with the exact degree of curing established to gel the material but regulated so that the material is not completely cured prior to removal from the stamp or master. By precisely regulating the degree of photoresist curing, the substrate can be removed from the master without excessive adhesion, which may otherwise render that step either impossible or otherwise resulting in damage to the stamp or the substrate. Furthermore, the use of photodiodes also ensures that UV light emissions occur at a cool temperature to minimize distortion of the imprinted part upon cooling.

Control Module 17

As referenced above, control module 17 is designed to regulate the principal operations of both high-power UV lamp 15 and chiller 19. As can be seen, control module 17 comprises an open, rack mount cabinet, or rack, 41 in which are retained (i) a main controller, or processor, 43, (ii) a series of power supplies 45-1 thru 45-4 for powering each of LED banks 23-1 thru 23-4, respectively, and (iii) a capacitor array, or relay module, 47 for storing additional energy that is used to, inter alia, overdrive LEDs 23. Lastly, control module 17 includes a PC-type user interface (UI) 49 that is externally mounted on cabinet 41. In use, user interface 49 enables an operator to monitor and selectively control certain operations of programmable system 11.

At a given temperature, the power output of each LED 23 is nearly directly proportional to its applied current. Above its threshold voltage, each LED 23 has a nearly linear current-voltage (I-V) curve, the slope of which represents its resistance. For example, using model SBM-120 ultraviolet LED, which is manufactured by Luminus, Inc., current, I, has a near linear relationship to voltage, V, under the following condition: I=0.5V-13.75, which varies slightly from LED to LED. It is for this reason, that LEDs are most commonly controlled in terms of current in order to regulate its light output.

This invention, however, utilizes voltage control to charge capacitors in capacitor array 47. The total charge on the capacitors in capacitor array 47 is measured in coulombs. The number of coulombs discharged per second by capacitor array 47 is represented as current in amperes. Using the model SBM-120 UV LED referenced above, nominal 100% optical output of the LED at 2.25 amps is 10 watts. In one second, 10 joules is delivered to each LED. Thus, control module 17 can calibrate the duration and value of current applied to LEDs 23 using measurements from feedback diodes to provide a highly accurate curing dosage.

The object of this invention is to control temperature and, more specifically, minimize temperature at the LED emitter as well as the target substrate. To achieve this object, LEDs 23 are operated in pulse mode. In fact, an object of this invention is to accommodate much higher powers than the ratings of each LED 23 through the application of very short pulses of controlled energy which is achieved, in part, by shifting to voltage control.

Notably, capacitors in capacitor array 47 are charged to a targeted voltage and then discharged by control module 17 into a selection of LED 23 through switching of a high speed-transistor. The dosage, D, can be calculated using the following formula: $\eta x \frac{1}{2} CV^2$, where $\eta$ represents the conversion efficiency, C is the capacitance of array 47, and V is the voltage set to charge capacitor array 47 above the threshold voltage of each LED 23.

As will be shown further below, the shape of the resultant discharge curve (in current over time) is exponential decay when the switching transistor is on and the time constant is equal to RC. Therefore, the current, $I_C$, from capacitor array 47 during the period of discharge can be represented using the formula: $I_C = V_0/R\ e^{-t/RC}$. Optionally, current $I_C$ can be combined with the charging current of the designated power supply 45 to yield a combined discharge curve that is represented in current over time. With an energy conversion efficiency of about 35% at 25° C., the dosage can be computed by calculating the total area under the combined discharge curve. The pulse height and dosage per pulse can then be set by setting the charging voltage to a level which is considerably higher than the rating of the diode. The current applied during an overdriving pulse can not only exceed the rating of each LED 23, but also, the rating of each power supply 45. As a result, the relatively long charging and LED deactivation period allows heat to adequately dissipate while, at the same time, the relatively short period of high-power LED activation allows for maximum absorbance and reaction locally on the surface where the cure or treatment is being applied (e.g. substrate 13).

As noted above, each power supply 45 is designed to supply power to a corresponding bank of LEDs 23. Accordingly, it is to be understood that, if UV lamp 15 is alternatively configured with a greater number of LED banks 23, a commensurate number of power supplies 45 should be utilized to ensure a direct one-for-one powering of each LED bank by a corresponding power supply 45.

Furthermore, as referenced previously, control module 17 is responsible for overdriving LEDs 23 in order to yield high-power UV light 21. At the same time, control module 17 limits activation of LEDs 23 to short bursts and, in turn, monitors thermal energy levels to ensure that, inter alia, LEDs 23 do not overheat and ultimately burnout. This ability to regulate the temperature produced by lamp 15 due to the overdriving of LEDs 23 therefore serves as a principal novel feature of the present invention.

Chiller 19

In the present embodiment, chiller 19 is represented as a 5000-Watt chiller that is disposed in fluid communication with UV lamp 15 via coolant conduit 51. As part of its principal operation, chiller 19 is designed to continuously deliver refrigerated coolant to UV lamp 15 via conduit 51 in order to prevent overheating of LEDs 23 as well as limit the transfer of heat onto designated substrate 13.

However, it should be noted that chiller 19 is not limited to any particular type and/or power level of heat-removal machine. Rather, it is to be understood that the power of chiller 19 is preferably matched based on the predicted thermal output produced by UV lamp 15. In this manner, heat is preferably removed via sub-ambient temperature coolant that circulates through lamp 15, therefore enabling the temperature of UV lamp 15 to remain at near ambient temperatures, which is highly desirable.

As can be seen, chiller 19 includes a central processor 53 that regulates its primary operation, processor 53 being in electrical communication with control module 17. Accordingly, control module 17 can ensure the proper continuous operation of chiller 19 that is required to maintain a near-ambient average temperature for LEDs 23.

Operation of System 11

In use, high-power light system 11 is designed to operate in the following manner. Specifically, wafer 13 is removably disposed within complementary cartridge 29 prior to activation of UV lamp 15. As noted above, UV lamp 15 and plate 27 together limit the emission of UV light 21 to a uniform circular region on wafer 13 that is approximately 200 mm in diameter (i.e. to roughly match the dimensions of substrate 13 and thereby minimize re-emission of light).

As previously referenced, control module 17 preferably regulates UV lamp 15 to emit light at 200%-500% of the nominal power of LEDs 23, with UV light 21 produced therefrom having a wavelength in the range of approximately 365-405 nm. As can be appreciated, restricting UV light 21 to a very narrow wavelength range (e.g., within 5 nm of the target wavelength) minimizes thermal energy, as wavelengths of light outside of the target range are nonactinide and, if absorbed, are converted to heat. Most notably, infrared energy produces a relatively large thermal output and, as such, the filtering of infrared light produced by UV lamp 15 is undertaken to the greatest extent possible.

Figure 2:
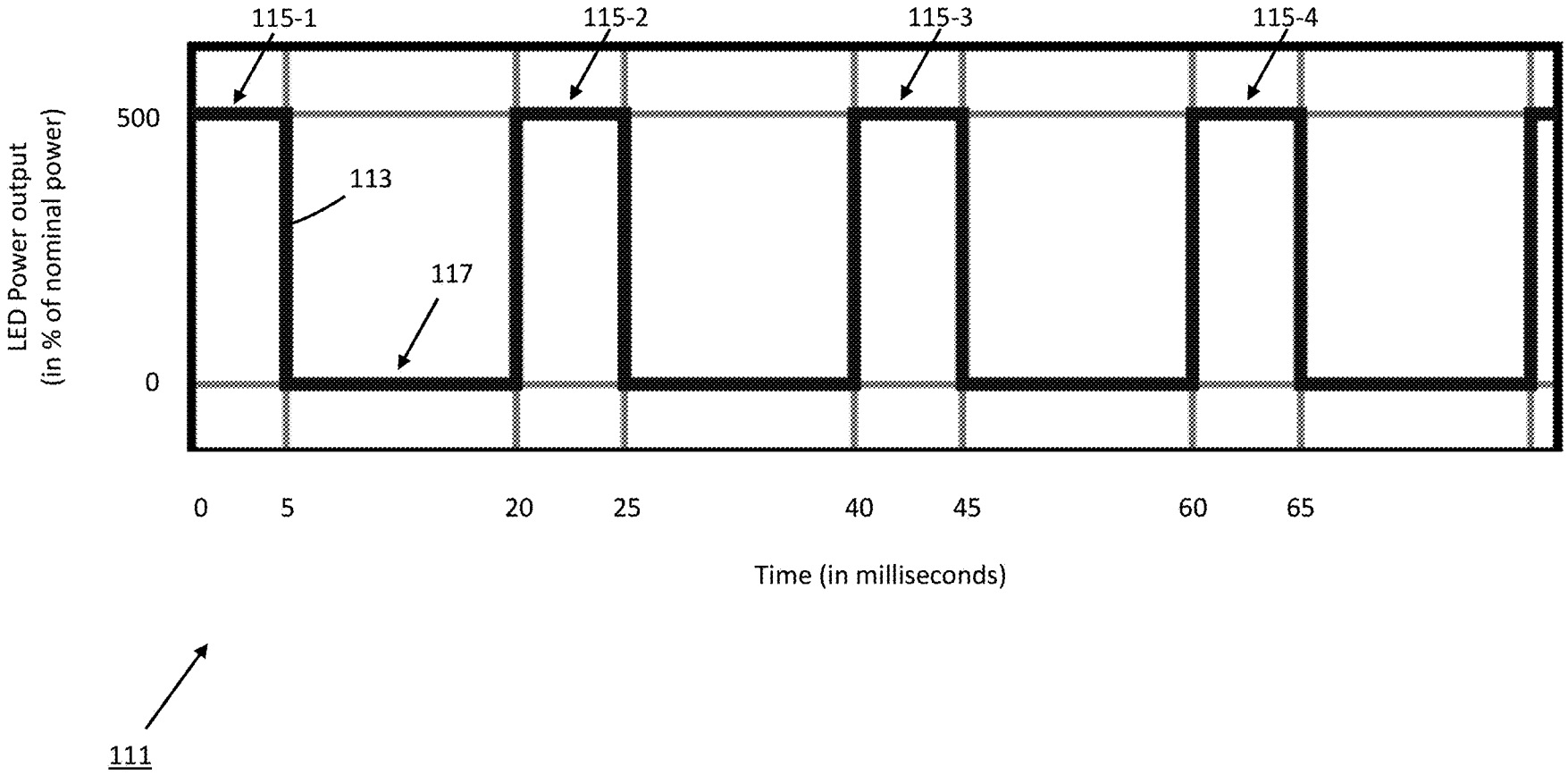
FIG. 2 is a graphical illustration of a sample power output cycle to be implemented by the high-power lamp shown in FIG. 1.

Due to the considerable heat generated from UV lamp 15 operating at such a high-power output, control module 17 operates UV lamp 15 in compliance with a designated pulse wave, or train. For example, in FIG. 2, a chart 111 is provided which includes a pulse train 113 that represents a sample power cycle for UV lamp 15. As can be seen, pulse train 113 comprises a series of limited-duration, high-power output pulses 115-1 thru 115-4, with each pair of successive pulses 115 being separated by a deactivation period 117 which is substantially greater in duration than the length of each pulse 115.

In illustrative chart 111, UV lamp 15 is shown preferably pulsed under the following conditions: pulsed on at 500% of the nominal power of LEDs 23 for approximately 5 milliseconds, and subsequently pulsed off for approximately 15 milliseconds, with the aforementioned pulse pattern repeating throughout operation.

However, because the operational pulse train is programmable and can be modified by control module 17, it is to be understood that the aforementioned pulse cycle 113 could be modified for the most optimal use in its intended application. For instance, the programmable pulse train may include a pulse duration selected from the range of 1 microsecond to 20 milliseconds, with a commensurate rest, or deactivation, period that is at least three times the selected pulse duration to yield an optimal duty cycle in the range of approximately 5% to approximately 30%. This extended period of deactivation for LEDs 23 limits the degree of infrared energy produced by LEDs 23, maximizes heat dissipation, and thereby minimizes the risk of overheating.

Figure 3:
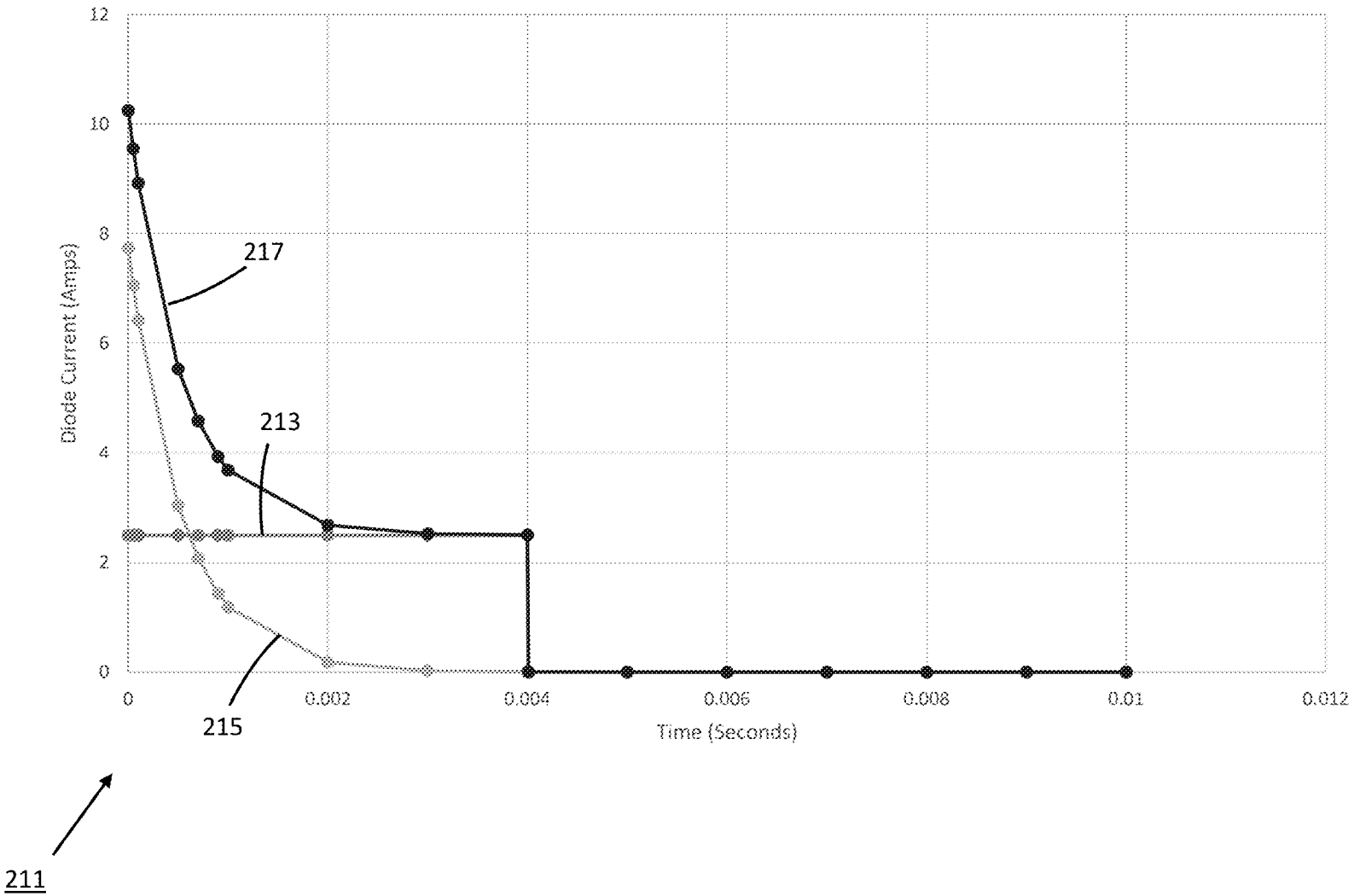
FIG. 3 is a graphical illustration of a sample current profile for each diode in the high-power lamp when pulsed with power during the output cycle shown in FIG. 2.

Referring now to FIG. 3, an illustrative graph 211 is shown which depicts a sample current profile for each active LED 23 when overdriven during activation pulse 115. Specifically, overdriving each LED 23 during pulse 115 is achieved through the combination of (i) the continuous application of fixed current 213 (represented herein as 2.5 amps) from its designated power supply 45 throughout the entirety of the pulse period, and (ii) an exponential decay of current 215 (represented herein as starting at 7.75 amps) provided from capacitor array 47.

Together, currents 213 and 215 yield a combined application of current 217 to LED 23 during each pulse 115 that is optimized to minimize heat generation, maximize heat dissipation and, at the same time, maximize manufacturing output. In particular, by providing peak optical power at the beginning of each pulse period (i.e. when temperature levels are lowest), adequate temperature control can be maintained while overdriving LEDs 23.

In other words, system 11 is designed such that a dedicated power supply 45 delivers continuous nominal power to LED 23 during its period of activation to produce light at near 100% of its nominal output (which is slightly conditional upon certain additional factors, such as ambient temperature). Accordingly, to overdrive each LED 23, capacitor array 47 is charged to a targeted voltage so as to allow for the delivery of a specific exponentially decaying current to LED 23. Because the current level delivered from capacitor array 47 to LED 23 can be acutely regulated by control module 17, the power output of LED 23 can be controlled with great accuracy with respect to time and output energy (i.e. producing light as great as 300-500% of its nominal output), thereby ensuring adequate heat dissipation while maximizing output yield.

It is also to be understood that control module 17 may temporarily suspend pulse cycle 113 if temperature sensor 31 measures ambient temperature levels which exceed a predefined threshold. In this scenario, control module 17 would suspend operation of UV lamp 15 until the measured temperature returns to an acceptable level. Thereafter, control module 17 would resume normal operation of UV lamp 15 under either the original pulse cycle 113 or a modified pulse cycle that more adequately prevents future overheating (e.g. by lengthening the deactivation period and/or reducing the LED power output).

Preferred Lamp Construction to Ensure Uniform Light Distribution

As an important aspect of the present invention, high-power lamp 15 is preferably constructed so as to produce uniform light distribution onto the target surface that may otherwise be lacking due to slight differences in the response curves for each LED 23. The variances in the response curves is a result of LEDs 23 being connected both in parallel and series from a single current source, thereby preventing individual LED control. In particular, because certain LEDs 23 in lamp 15 are connected in parallel, the current applied to each LED 23 varies, resulting in the generation of output light at different levels of brightness. This variance in illumination creates non-uniformity of light distribution across the target surface, as will be explained further below. It is to be understood that non-uniformity of light distribution across the target surface can significantly compromise overall effectiveness in the intended application (e.g., light absorption for curing applications) and, as such, is considered highly undesirable.

Figure 4:
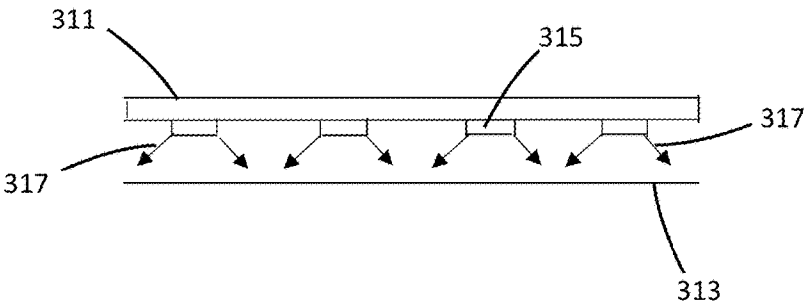
FIG. 4 is a simplified illustration of a sample LED module adapted for use in the high-powered lamp shown in FIG. 1, the LED module being shown relative to a target surface.

Referring now to FIG. 4, there is shown a simplified illustration of a sample LED module 311 for high-powered lamp 15. As can be seen, LED module 311 is disposed directly above a target surface 313. LED module 311 comprises a plurality of individual LEDs 315, each LED 315 emitting light as conical rays 317. The conical emission of light from equidistantly-spaced LEDs 315 results in non-uniform light distribution across target surface 313, wherein the greatest amount of optical power received by target surface 313 is located directly beneath LEDs 315 and the least amount of optical power received by target surface 313 is located at the approximate midpoint between adjacent LEDs 315.

Figure 5:
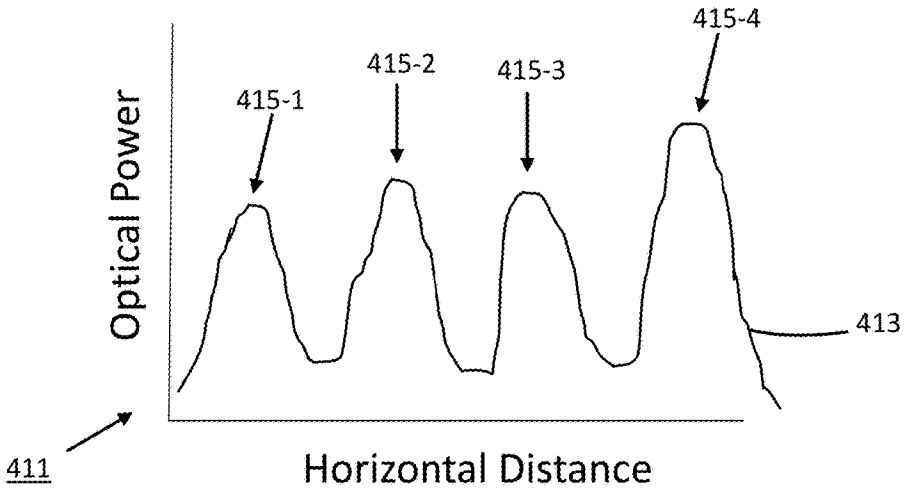
FIG. 5 is simplified graphical illustration of the non-uniform light distribution pattern produced by the LED module in FIG. 4 onto the target surface.

In FIG. 5, a simplified graphical illustration of the non-uniform light distribution produced by LED module 311 is shown, the graph being represented generally by reference numeral 411. In graph 411, an illumination distribution pattern 413 is provided which represents the optical power received by target surface 313 relative to horizontal location. As can be seen, peak optical power 415-1 thru 415-4 aligns directly beneath each LED 315, with optical power dropping considerably at the approximate midpoint between adjacent LEDs 315. As noted above, this non-uniformity of light can compromise the effectiveness of lamp 15 in its intended application.

Accordingly, in order to homogenize the illumination, LEDs 23 are preferably positioned a fixed distance away from substrate 13 such that, when coupled with the emission cone angles, the light from each LED 23 covers the entire target surface. This configuration results in illumination of the target surface with more uniform light but with higher intensity in its center.

Figure 6:
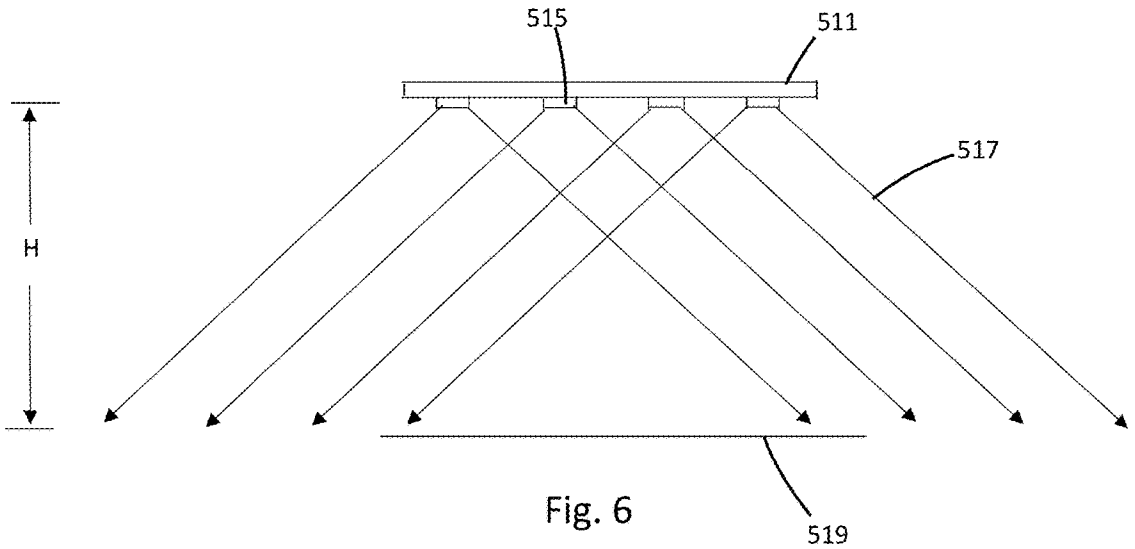
FIG. 6 is a simplified illustration of another sample LED module adapted for use in the high-powered lamp shown in FIG. 1, the LED module being shown relative to a target surface.

To illustrate this principle, Referring now to FIG. 6, there is shown a simplified illustration of a sample LED module 511 for high-powered lamp 15. As can be seen, LED module 511 is similar to LED module 311 in that LED module 511 comprises a plurality of individual LEDs 515, each LED 515 emitting light as conical rays 517. The primary distinction between LED module 511 and LED module 311 is that LED module 511 is disposed at a considerable height H away from its target surface 519.

Figure 7:
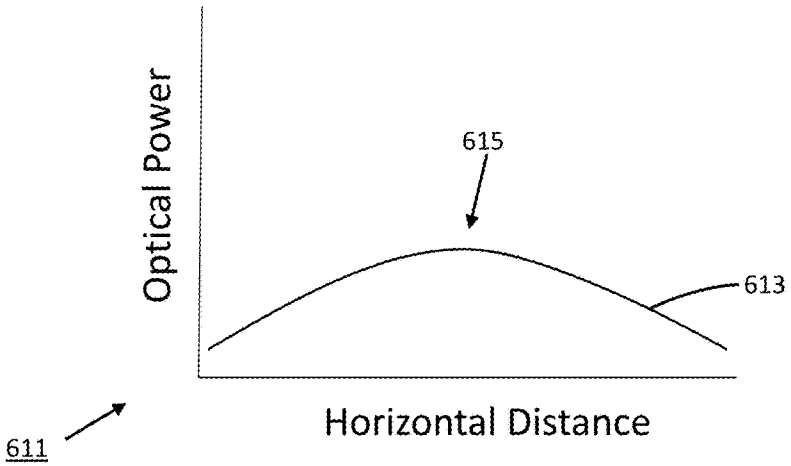
FIG. 7 is simplified graphical illustration of the moderately-uniform light distribution pattern produced by the LED module in FIG. 6 onto the target surface.

Disposing LEDs 515 a considerable height H away target surface 519 allows for each LED 515 to illuminate the entirety of target surface 519 and thereby serves to improve uniformity of the overall light distribution. For ease of understanding, FIG. 7 depicts a simplified graphical illustration of the light distribution applied by LEDs 515 onto target surface 519, the graph being represented generally by reference numeral 611. In graph 611, an illumination distribution pattern 613 is provided which represents the optical power produced by LED module 511 relative to the horizontal location on target surface 519. As can be seen, illumination distribution pattern 613 is considerably more uniform than illumination distribution pattern 413.

However, it is to be understood that disposing LEDs 515 a considerable height H from target surface 519 significantly reduces the optical power, thereby compromising output yield. Additionally, illumination distribution pattern 613 has a radial illumination gradient, with a peak 615 located at the approximate midpoint of module 511.

Figure 8:
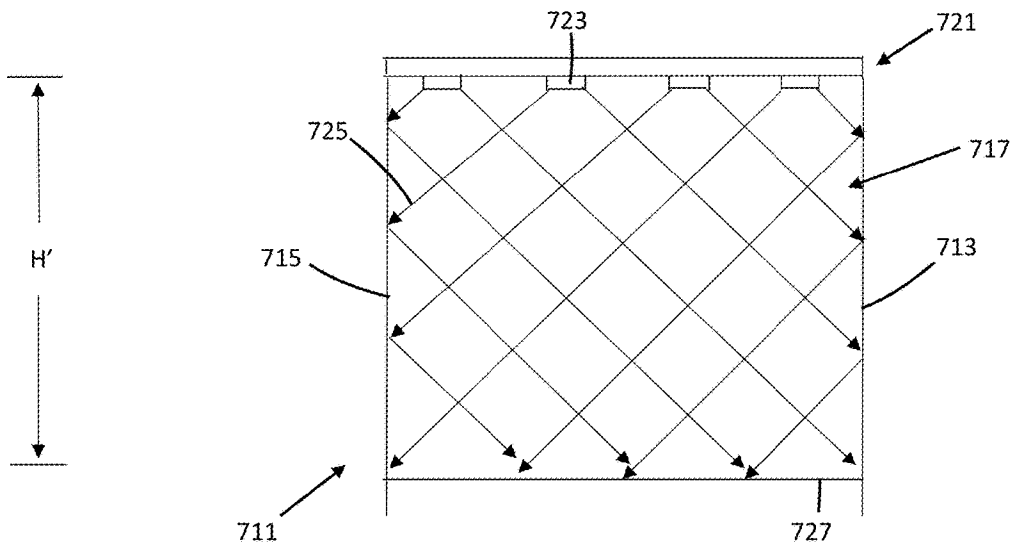
FIG. 8 is a simplified illustration of a high-power, LED lamp adapted for use in the light system shown in FIG. 1, the LED lamp being shown relative to a target surface.

Therefore, as a feature of the present invention, high-power lamp 23 is preferably constructed with a cuboid illumination pattern. For example, in FIG. 8, there is shown a high-power, LED lamp 711 which is designed principally for use in light system 11. As can be seen, lamp 711 comprises a box-shaped housing 713 with four orthogonal side panels 715 that together define an interior cavity 717.

Lamp 711 additionally comprises an LED module 721 with a plurality of individual LEDs 723, each LED 723 emitting light as conical rays 725. Similar to LED module 511, LED module 721 is preferably fixedly mounted within housing 713 at a considerable height H' away from its target surface 727 such that each LED 723 illuminates the entire target surface 727.

As a unique feature of the present invention, the internal surface of the four, orthogonal side panels 715 is mirrored or otherwise light-reflective so that the illuminating plane above the rear face appears as an infinite plane that begins in proximity to the intersection of that plane with LEDs 723 and extends approximately to target surface 725. Through the reflection of conical rays 725 off side panels 715, highly uniform light distribution onto target surface 727 is achieved.

Figure 9:
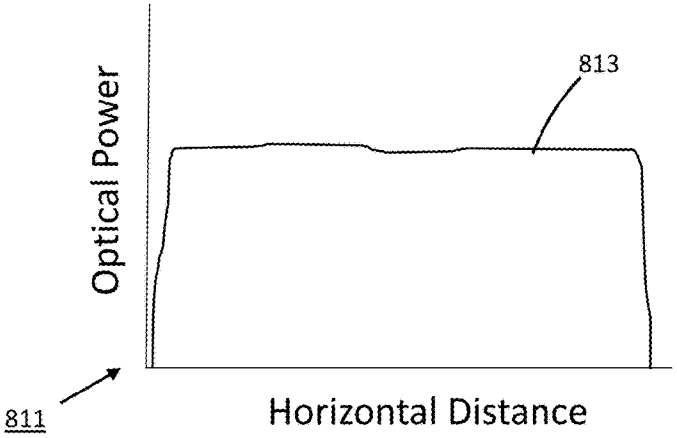
FIG. 9 is simplified graphical illustration of the highly-uniform light distribution pattern produced by the LED lamp in FIG. 8 onto the target surface.

To illustrate this principle, FIG. 9 depicts a simplified graphical illustration of the light distribution applied onto target 727 by LED lamp 711, the graph being represented generally by reference numeral 811. In graph 811, an illumination distribution pattern 813 is provided which represents the optical power received by target 727 relative to its horizontal location. As can be seen, illumination distribution pattern 813 is not only considerably more uniform in power across the width of target surface 727, as compared to illumination distribution pattern 613, but also produces a far greater amount of total optical power than illumination distribution pattern 613.

Figure 10:
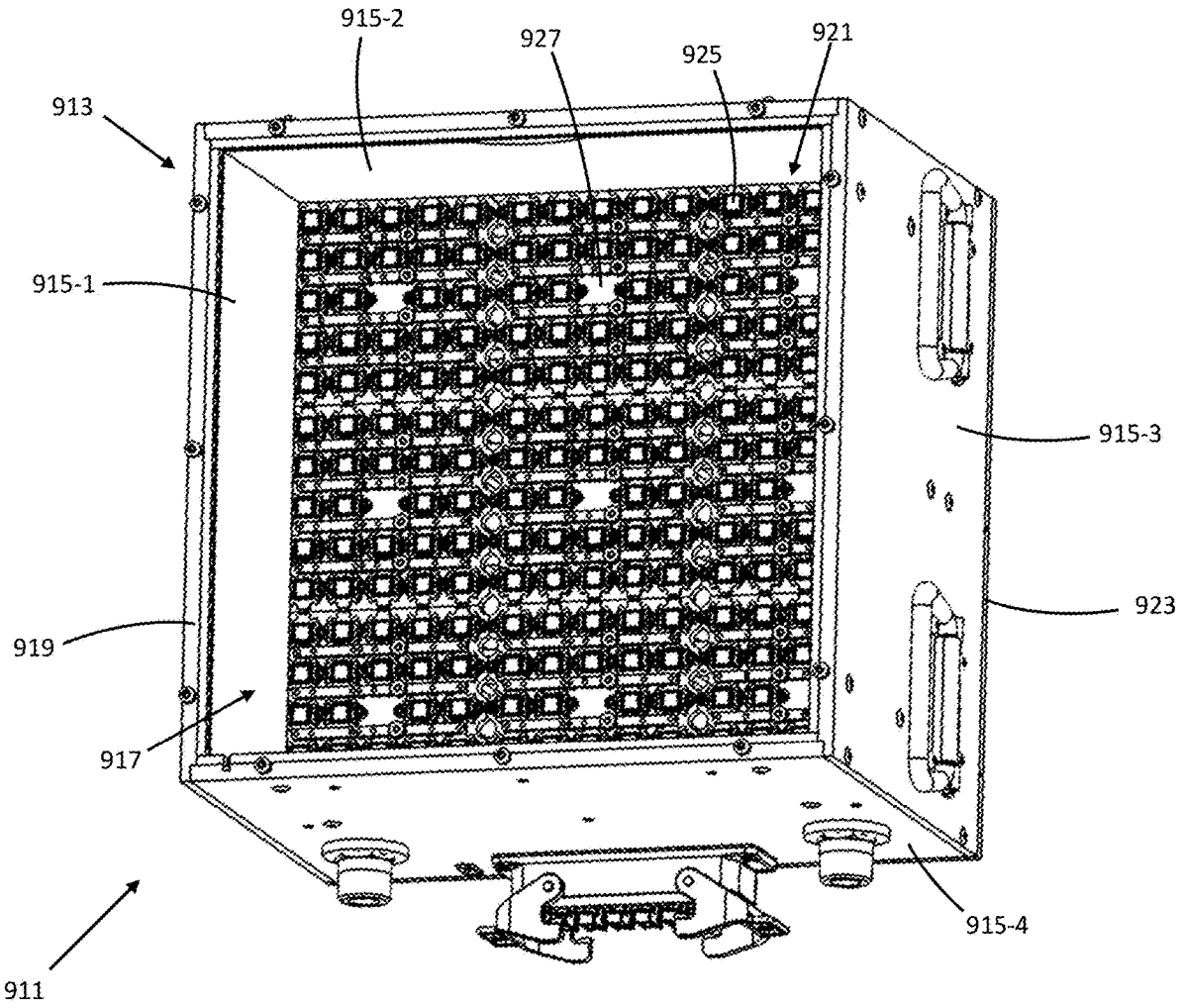
FIG. 10 is a detailed bottom perspective view of a high-power, LED lamp adapted for use in the light system shown in FIG. 1.

Referring now to FIG. 10, there is shown a detailed, bottom perspective view of a high-power, LED lamp designed principally for use in light system 11, the lamp being identified generally by reference numeral 911. As can be seen, lamp 911 comprises a box-shaped housing 913 with four orthogonal side panels 915-1 thru 915-4 that together define an interior cavity 917 and an open front end 919.

Lamp 919 additionally comprises a plurality of individual LED modules 921 which are fixedly mounted in a common plane within interior cavity 917 (e.g., against the interior surface of a rear panel 923 formed in housing 913). In the present embodiment, nine individual LED modules 921 are arranged in a 3×3 matrix. As can be appreciated, the utilization of a large quantity of individual LED modules 921 is beneficial for, among other things, producing a significant output of illumination energy.

Each LED module 921 is represented herein as comprising twenty-four individual LEDs 925 mounted onto a common plate 927, the LEDs 925 being arranged in a 5×5 grid with the center LED removed therefrom. Configured in this fashion, light produced from LEDs 925 is directed out through open front end 919 and onto a target surface (not shown), which is either coupled or disposed in close proximity to housing 913.

As can be appreciated, LED modules 921 are preferably mounted a significant distance away from open front end 919. Additionally, the internal surface of each of the four, orthogonal side panels 915-1 thru 915-4 is mirrored or otherwise light-reflective. As a result, light emitted from LEDs 925 reflects off side panels 915 so as to create a highly uniform light distribution pattern onto the target surface, which is highly desirable.

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A high-power light system, comprising:

(a) a high-power lamp for producing light within a defined wavelength range, the high-power lamp comprising a plurality of light emitting diodes mounted within a common housing;

(b) a chiller in thermal communication with the high-power lamp for maintaining the high-power lamp below a defined temperature threshold; and (c) a control module in electrical communication with the high-power lamp and the chiller, the control module comprising, (i) a controller for regulating the operation of the high-power lamp and the chiller, (ii) a power supply for powering the high-power lamp, and (iii) a capacitor array in electrical communication with the power supply for storing energy used to power the high-power lamp;

(d) wherein the controller delivers current from the capacitor array to the high-power lamp to activate a selection of the plurality of light emitting diodes, the controller restricting activation of the high-power lamp to an operational cycle comprised of periodic pulses of activation;

(e) wherein the capacitor array is charged to a target voltage by the power supply, wherein current discharged from the capacitor array to the high-power lamp overdrives the selection of the plurality of light emitting diodes.

2. The high-power light system as claimed in claim 1 wherein the control module activates the high-power lamp in accordance with an operational cycle which includes a repeating alternating sequence comprised of a period of activation followed by a period of deactivation.

3. The high-power light system as claimed in claim 2 wherein each of the period of activation and the period of deactivation is fixed in duration.

4. The high-power light system as claimed in claim 3 wherein the period of deactivation is at least three times as long in duration as the period of activation.

5. The high-power light system as claimed in claim 4 wherein the period of activation falls within the range of 1 microsecond to 20 milliseconds.

6. The high-power light system as claimed in claim 2 wherein each of the plurality of light emitting diodes has a nominal power.

7. The high-power light system as claimed in claim 6 wherein the high-power lamp overdrives a selection of the plurality of light emitting diodes during the period of activation at a range between 300-500 percent of the nominal power.

8. The high-power light system as claimed in claim 7 wherein the high-power lamp overdrives a selection of the plurality of light emitting diodes during the period of activation to produce high-power light within a defined wavelength range in the ultraviolet spectrum.

9. The high-power light system as claimed in claim 2 wherein the plurality of light emitting diodes is arranged into multiple, independently-operable, light emitting diode (LED) modules.

10. The high-power light system as claimed in claim 9 wherein each LED module is directly powered by a corresponding power supply in electrical communication therewith.

11. The high-power light system as claimed in claim 2 wherein the high-power lamp comprises at least one temperature sensor for monitoring temperature within the high-power lamp, the at least one temperature sensor being in electrical communication with the control module.

12. The high-power light system as claimed in claim 11 wherein the control module monitors the temperature measured by the at least one temperature sensor and modifies the operational cycle for the high-power lamp if the measured temperature exceeds the defined temperature threshold.

13. The high-power light system as claimed in claim 12 wherein the high-power lamp further comprises a cartridge coupled to the housing, the cartridge being adapted to retain a substrate onto which light produced by the plurality of light emitting diodes is directed.

14. The high-power light system as claimed in claim 2 wherein the common housing is box-shaped and includes four side panels that together define an interior cavity.

15. The high-power light system as claimed in claim 14 wherein the plurality of light emitting diodes are fixedly mounted onto the common housing, the plurality of light emitting diodes being adapted to distribute light uniformly across a target surface.

16. The high-power light system as claimed in claim 15 wherein the four side panels of the common housing are light reflective.

* * * * *